United States Patent [19]

Kennedy

[11] Patent Number: 5,065,930

[45] Date of Patent: Nov. 19, 1991

[54] SPIRAL FEED FASTENER

[76] Inventor: George W. Kennedy, 111 N. Pompano Beach Blvd., Pompano Beach, Fla. 33062

[21] Appl. No.: 571,936

[22] Filed: Aug. 23, 1990

Related U.S. Application Data

[60] Division of Ser. No. 428,070, Oct. 27, 1989, Pat. No. 4,981,246, which is a continuation-in-part of Ser. No. 153,768, Feb. 8, 1988, Pat. No. 4,867,367, which is a continuation-in-part of Ser. No. 882,345, Jul. 7, 1986, Pat. No. 4,728,021.

[51] Int. Cl.[5] ..... B25C 5/13; B25C 5/16

[52] U.S. Cl. ..... 227/130; 227/114; 227/120; 227/148; 227/153; 29/772; 29/787; 29/818

[58] Field of Search ..... 29/432, 525.2, 772, 29/787, 798, 799, 818; 227/95, 107, 109, 119, 120, 148, 152, 153, 155, 156, 114, 130; 269/910

[56] References Cited

U.S. PATENT DOCUMENTS

| | | | |
|---|---|---|---|
| 4,318,555 | 3/1982 | Adanski et al. | 227/78 X |
| 4,512,506 | 4/1985 | Fischer | 227/78 X |
| 4,746,046 | 5/1988 | Frye | 227/156 X |

FOREIGN PATENT DOCUMENTS

| | | | |
|---|---|---|---|
| 168142 | 6/1954 | Australia | 227/120 |
| 596035 | 4/1960 | Canada | 227/120 |
| 769545 | 3/1957 | United Kingdom | 227/120 |

*Primary Examiner*—Joseph M. Gorski
*Assistant Examiner*—Peter Dungba Vo
*Attorney, Agent, or Firm*—Thomas, Kerr & Kayden

[57] ABSTRACT

An automatic fastening machine where strips of covered fasteners (11) are fed from a reel 16 of fasteners into the rear of the fastening machine along a guide means (12) as needed. A fastener advancing means (13) intermittently urges the strip of fasteners toward a drive element (60). The drive element engages the top of the foremost fastener of the strip of fasteners to force the fastener into a work piece.

9 Claims, 4 Drawing Sheets

SPIRAL FEED FASTENER

CROSS REFERENCE

This is a divisional of copending application Ser. No. 07/428,070 filed on 10/27/89, now U.S. Pat. No. 4,981,246 which is a continuation-in-part of U.S. Pat. application Ser. No. 153,768 filed Feb. 8, 1988 now U.S. Pat. No. 4,867,367 which is a continuation-in-part of U.S. patent application Ser. No. 882,345 filed July 7, 1986 now U.S. Pat. No. 4,728,021.

FIELD OF THE INVENTION

This invention relates in general to automatic fastening machines, particularly to automatic fastening machines of the type used in a continuous production line where a plurality of machines are operated automatically to drive fasteners such as staples, nails and the like into a work product such as lattices, pallets, fence panels and the like. For example, several fastening machines are mounted on a common frame above a surface conveyor which carries a work product underneath the fastening machines, and triggering devices responsive to the movement of the work product to a predetermined position actuate the fastening machines which drive fasteners into the work product. These types of systems usually operate at a pace faster and more accurately than could be achieved in a manual operation. Therefore a large amount of fasteners consistently supplied to the fastening machines in proper orientation is required. In particular, this invention relates to the means by which the fasteners to be driven in the work piece are fed into the fastening machine.

BACKGROUND OF THE INVENTION

In the prior art, clips of cohered fasteners have been placed on a guide with a spring biased pusher in contact with the rearmost fastener of the clip which urges the clip along the guide toward the driving head of the fastening machine. This method of urging the clip of fasteners toward the driving head ensures that fasteners are moved into the path of the driving head but this method also causes delays when a clip of fasteners has been exhausted because the pusher must be retracted to allow another clip of fasteners to be placed on the guide. Such interruptions in production can be very costly due to lost productivity. Prior art systems also have been developed that automatically retract the pusher when a new clip of fasteners is needed and place a new clip on the guide; however, this also requires a brief interruption of the system and these mechanisms are relatively expensive.

SUMMARY OF THE INVENTION

Briefly described, the present invention comprises a fastening machine of the type used in automated production systems in which work products such as lattices, fence panels and pallets are produced, whereby several fastening machines are mounted adjacent a conveyor that carries the work product. Each fastening machine has its own strip of fasteners and drive element for driving the fasteners from the end of the strip into the work product. A supply strip of fasteners is contained in a fastener supply reel which is positioned adjacent a fastener advancing means that feeds the fasteners to the drive element substantially continuously, being limited only by the capacity or size of the reel. The fastener advancing means operates without the use of a traditional pusher and is open above and at both ends of the fastener strip guide means which allows new fasteners to move from the fastener supply reel onto the guide means as the new fasteners are needed, thereby providing interruption-free production. The reel of fasteners contains far more fasteners than the clips of the prior art, and reel substitutions may be accomplished without interrupting operation.

More particularly, the fastener advancing means comprises a fastener guide upon which a strip of fasteners from the fastener reel travels toward the drive element. The movement of the strip of fasteners along the guide is caused by advancing elements engaging the side surfaces of the strip of fasteners, and the advancing elements are pulled toward the drive element on each cycle of operation of the drive element of the fastening machine. Cam surfaces on the advancing elements, which engage cam surfaces on adjacent members in conjunction with a pair of pneumatic cylinders which apply a reciprocating motion thereto, provide the movement of these advancing elements.

The urging of the strip of fasteners by the advancing elements toward the drive element during each cycle of operation of the fastening machine ensures that the leading fastener of the strip of fasteners on the guide is urged toward the drive element as the drive element is actuated so that a fastener is properly positioned beneath the drive element. As the strip of fasteners on the guide is consumed the reel of fasteners pays out more fasteners without interruption through the open end of the fastener guide means. The fastener advancing elements pull the fasteners from the reel in a continuous strip and urge the new supply of fasteners from the reel toward the drive element of the fastening machine.

One embodiment of the invention comprises one or more fastening machines supported over a surface conveying system capable of driving U-shaped staples into the work piece moving on the surface conveyor. A plurality of staples in flat abutment with one another are adhesively connected together on at least one side surface of the staples, for example, to form a long U-shaped strip of staples with the points of the staples extending downwardly when delivered to the fastener advancing means of each fastening machine from the staple supply reel. The guide of each fastener machine comprises a rectilinear rail upon which the supply of staples travels in a straddled relationship.

A second embodiment of the invention comprises fastening machines positioned above and below the surface conveyor capable of simultaneously driving fasteners into both sides of a work piece. The lower machines are positioned below the conveyor in an orientation to drive fasteners upwardly into the bottom of a work piece and each one has a support means for retarding any backward movement by the fasteners due to gravity as the fasteners are moved upwardly along the guide toward the drive element of the fastening machine. The lower fastener support means of each lower fastener machine comprises a cover plate extending over the guide and a pair of spring members contacting the sides of the fasteners to apply a force which hold the fasteners in place. The upper machines are positioned above the conveyor in an orientation opposing the lower fastening machines to drive fasteners downwardly into the top of a work piece in simultaneous operation with the fastening machines below the conveyor.

Thus, it is an object of this invention to provide a fastening machine which will operate continuously for an extended period of time with minimal operator intervention necessary.

Another object of this invention is to provide a fastening machine which automatically and substantially continuously supplies new fasteners to the guide of the fastener machine as the fasteners on the guide are used up.

Another object of this invention is to provide a fastening system which functions to drive fasteners downwardly into the upwardly facing surface of a work product and upwardly into the downwardly facing surface of a work product.

Other objects, features and advantages of the present invention will become apparent upon reading the following specification, when taken in conjunction with the accompanying drawings.

DETAILS OF THE PREFERRED EMBODIMENT

Figure 1:
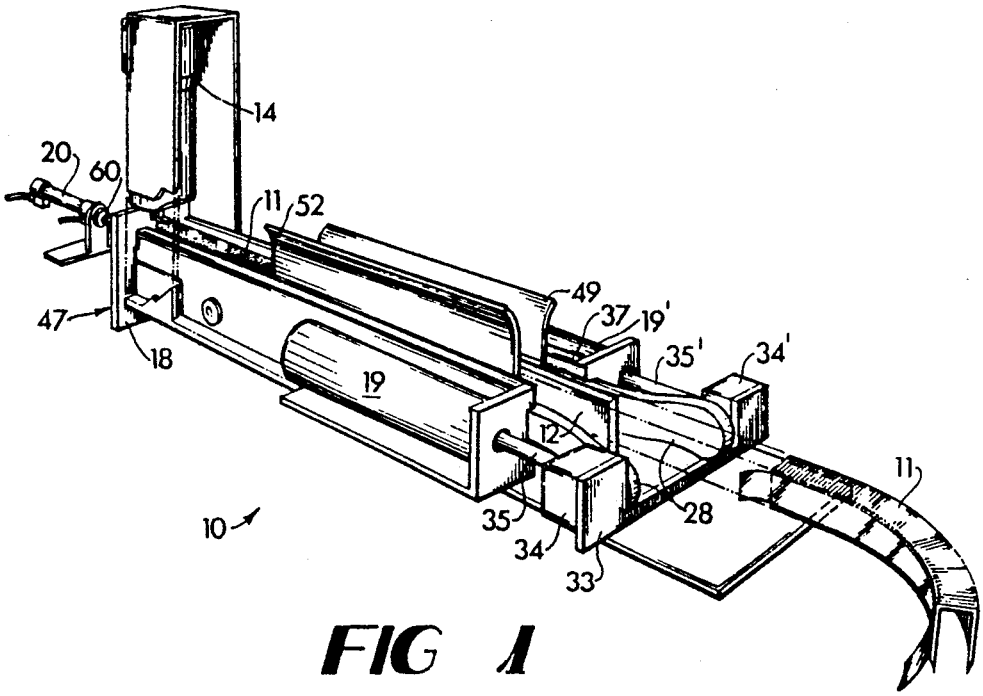
FIG. 1 is a perspective view, of the fastening machine showing the basic components when staples are used as the fasteners.
Figure 2:
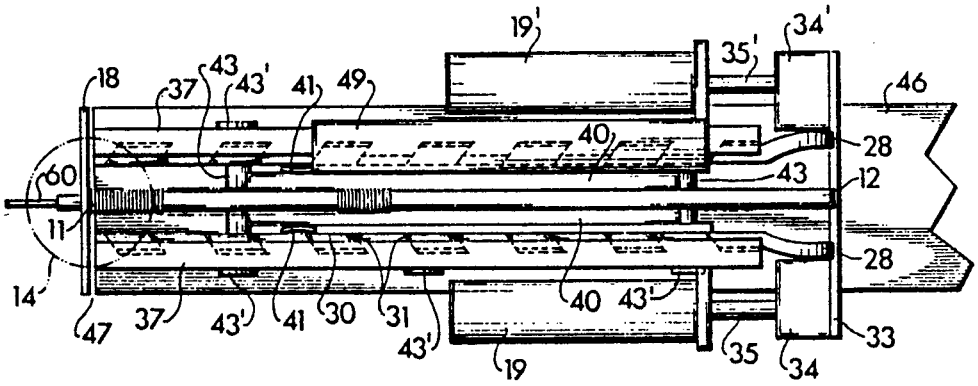
FIG. 2 is a plan view of the staple advancing means shown with a strip of staples on the staple guide.
Figure 4:
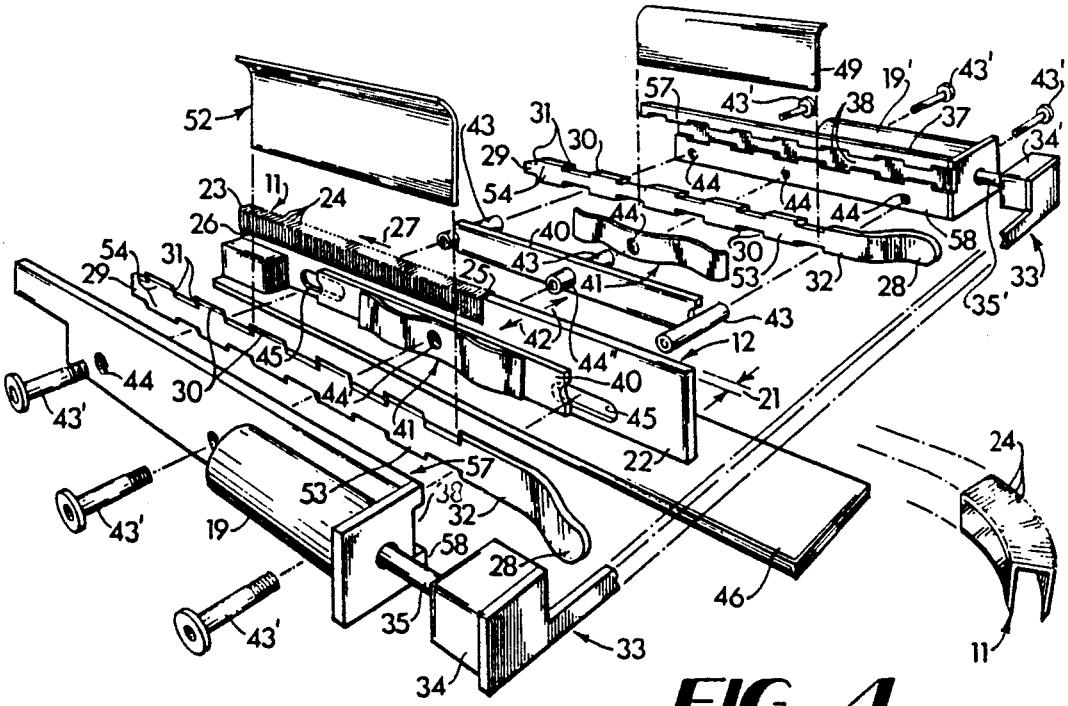
FIG. 4 is an exploded perspective view of the staple advancing means showing details of the assembly.

Referring now in detail to the drawings in which like numerals indicate like parts throughout all views, FIGS. 1, 2, and 4 show a staple machine 10 having a strip of staples 11 seated on staple guide 12 with staple advancing means 13 powered by pneumatic cylinders 19 and 19', only 19 being shown in FIG. 1. The staple drive element 14 of the fastening machine is shown directly over staple discharge chute gate 18. A pneumatic cylinder 20 is shown with an extension shaft 60 in its distended position abutting the backside of discharge chute gate 18.

The staple guide 12 has width 21 (FIG. 4), vertical sides 22, a discharge end 26 and a horizontal support plate 46. Several slotted mounting openings 45 extend between the vertical sides 22 just above the horizontal support plate 46. A strip of staples 11 sits in straddled relationship on the staple guide 12. The strip of staples 11 has a frontmost staple 23, and following staples 24.

Figure 5:
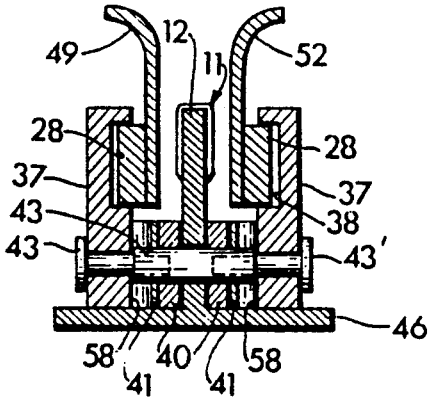
FIG. 5 is a cross sectional view of the staple advancing means showing the straddling relationship of the strip of staples on the staple guide.

There are two inside cam plates 28, one on each side of staple guide 12, extending parallel to staple guide 12 and each having a rectilinear main body 53 with front section 29 and rear section 32. A plurality of cam protrusions 30 extend vertically from the rectilinear main body 53 of each plate 28 and are spaced equidistant along a length of the inside cam plate 28. Each cam protrusion 30 has two side surfaces 54 and two cam surfaces 31. The side surfaces 54 are flush extensions of rectilinear main body 53 and are offset longitudinally from each other such that the cam surfaces 31 which run between the side surfaces 54 are not perpendicular to the side surfaces 54. As shown in FIG. 5, the outer perimeter of the protrusions which is formed by the edges 30 of cam surfaces 31 and side surfaces 54 has the shape of a parallelogram. All of the cam surfaces 31 along an inside cam plate 28 run parallel to one another and the two inside cam plates 28 have shapes that are mirror images of one another. The rear section 32 of each inside cam plate 28 is abutted by a connecting yoke 33 extending therethrough perpendicular to the staple guide 12.

Figure 6:
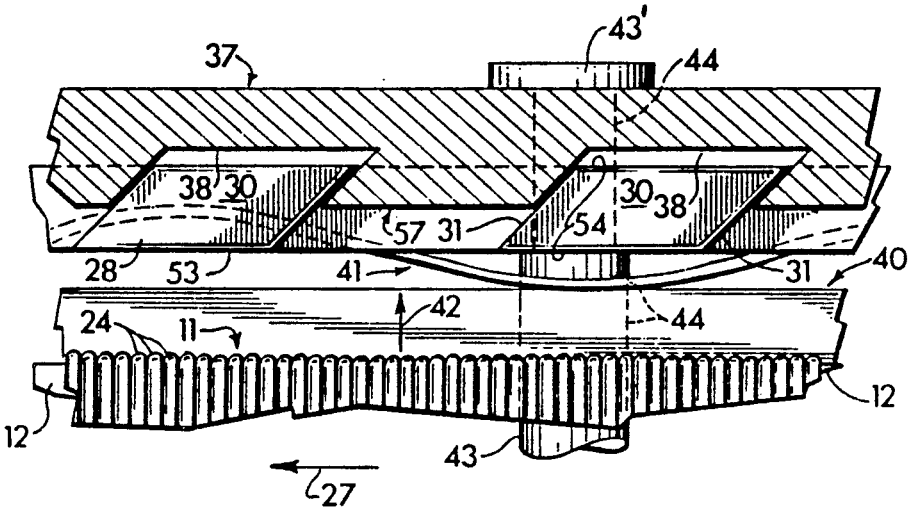
FIG. 6 is a close up detail top view of the cam surfaces in relation to the strip of staples.

As illustrated in FIGS. 4 and 6, two outside cam plates 37 are positioned parallel to staple guide 12 and just outside the inside cam plates 28. Each of the outside cam plates 37 has a rectangular outer periphery 56 and a plurality of circular mounting holes 44 extending therethrough perpendicular to the staple guide 12. The inner engaging sides 57 of outside cam plates 37 have cam surface indentations 38 of depth and configuration to match the thickness and configuration of the inside cam plate 28 adjacent thereto. The engaging sides 57 also have bearing surfaces 58 located just below the cam surface indentations 38 and running the length of the outside cam plates 37.

Two rectilinear friction bars 40 extend parallel to and on either side of staple guide 12 and are seated on horizontal support plate 46. A leaf spring member 41 extending the length of friction bar 40 also is placed on horizontal support plate 46 juxtaposed friction bar 40. The spring member is positioned such that the direction of spring force as indicated by the arrows 42 extends perpendicularly outward from the vertical sides 22 of staple guide 12.

As shown in FIG. 2, the rear section 32 of inside cam plate 28 is attached to a piston member 34 which is affixed to the connecting yoke 33 abutting the rear section 32 of inside cam plates 28, and is attached to extension shaft 35 of pneumatic cylinder 19. Spacers 43 are inserted through slotted mounting openings 45 in the staple guide 12, with the middle spacer 43 also extending through the aligned mounting openings 44' and 44" of spring members 41 and friction bars 40, respectively. The entire staple advancing means is assembled by extending connectors 43' through the openings 44 of outside cam plates 37 on both sides of the staple guide and threading connectors 43' into both ends of spacers 43.

Once assembled, outside cam plates 37 rest upon the horizontal support plate 46, with bearing surfaces 58 abutting spring members 41. The spacers 43 tend to position the engaging sides 57 of outside cam plates 37 away from the vertical sides 22 of staple guide 12 a distance slightly less than the thickness of inside cam plates 28. The force applied by spring members 41 on both sides of the staple guide 12 tends to keep the outside cam plates "centered". Thus, because inside cam plates 28 are recessed into the cam surface indentations 38 when assembled, they have no means of escaping from the assembly when moved in the direction of the staple strip feed arrow 27.

As shown in FIG. 4, the spatial relationship between outside cam plates 37 and staple guide 12, provided by spacers 43, spring members 41 and friction bar 40, can be seen more clearly. Also shown in FIG. 4 is a staple strip positioning plate 52 rigidly attached to the inside surface of inside cam plate 28 on one side of staple guide 12, and staple strip positioning plate 49 rigidly attached to the inside surface of the inside cam plate 28 on the other side of staple guide 12. Both staple strip positioning plate 52 and staple strip positioning plate 49 extend parallel to staple guide 12.

Figure 3:
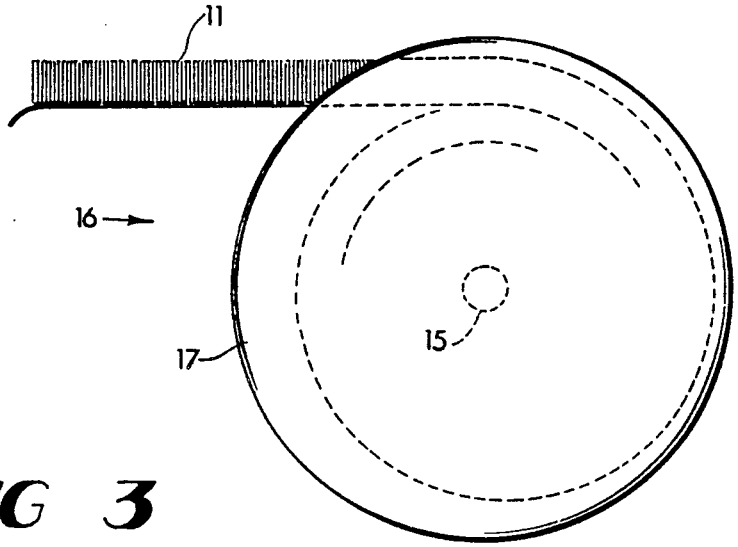
FIG. 3 is a plan view of the supply reel with a strip of staples unwinding from the supply reel.

The supply of staples is contained in a reel 16 (FIG. 3) wherein the staple strip is wound in a coil by adhesively connected staples which unwinds to provide a continuous supply of staples to the machine.

OPERATION

The operation of the stapling machine begins with pneumatic cylinder 20 pushing extension shaft 60 out to its distended position thereby holding discharge chute gate 18 in the proper position, at the same time the pair of pneumatic cylinders 19, 19' on the outside surfaces of cam plates 37 begin retracting extension shafts 35 and 35' from their extended position. The forward motion of the extension shafts 35 and 35' causes piston members 34 and 34' to move toward the discharge chute gate 18 moving the cam plates inwardly causing the inside cam plates 28 to begin their forward motion over the engagement of the cam surfaces 31 on the inside cam plates 28 with the cam surface indentations 38 on the outside cam plates 37, urging the inside cam plates 28 to move inwardly toward the strip of staples 11. Once the positioning plates 52, 49 have been moved by inside cam plates 28 into contact with the strip of staples 11, further inward movement of the cam plates 28 and positioning plates 52, 49 is prevented, but these elements continue their motion forward in response to the force applied by the pair of cylinders 19, 19'. The frictional contact of the outside cam plates 37 with the friction bars 40 and the staple guide is overcome by the further force of cylinders 19 and 19' urging the inside cam plates forward, and because the outside cam plates 27, spring members 41 and friction bar 40 are all tied together with connectors 43, they will all move forward with the inside cam plate 28 with the connectors 43 travelling along the slotted mounting openings 45 in the stationary staple guide 12. The strip of staples 11 will move forward with the inside cam plates 28 until the frontmost staple 23 has abutted the discharge chute gate 18. The distance the inside cam plates 28 will travel, however, is greater than the distance the strip of staples 11 will normally advance when only the frontmost staple has been previously driven off the strip of staples. Thus, the inside cam plates 28 will continue to move along the outside surfaces of the strip of staples 11 in sliding frictional contact, thereby assuring that the frontmost staple 23 will be firmly held against discharge chute gate 18.

The pneumatic cylinders 19, 19' and 20 are all connected to the same air supply with a special valve governing the flow of air to the drive element 14. This valve assures that the extension shaft 60 of pneumatic cylinder 20 has been completely extended while the extension shafts 35 and 35' of both pneumatic cylinders 19, and 19' on the outside surfaces of cam plates 37 have been completely retracted before drive element 14 begins its travel downward toward the frontmost staple.

Shortly after the drive element 14 has driven the frontmost staple 23 into the work piece, pneumatic cylinder 20 will begin to withdraw its extension shaft as pneumatic cylinders 19, and 19' begin to extend their extension shaft 35, and 35'. As extension shaft 35, and 35' are extended along the staple guide 12 away from the drive element, the inside cam plates 28 begin to move back, away from the discharge chute 18. The frictional contact of the outside cam plates 37 with the friction bars 40 and staple guide 12 again initially deters any rearward movement of the outside cam plates 37. The cam surfaces 31 on the inside cam plates 28 are retracted into the cam surface indentations 38 on the outside cam plates 37, moving the inside cam plates and positioning plates 52, 49 away from the strip of staples 11 immediately in response to the engagement of cam surfaces 31 with cam surface indentations 38. As the protrusions 30 become fully recessed back in the cam surface indentations 38 of outside cam plates 37, the outside cam plates 37, spring members 41, friction bars 40, spacers 43 and connectors 43' will start to move backwards with the inside cam plates 28 as the extension of extension shafts 35 and 35' of cylinders 19 and 19' exert a pulling force which overcomes the frictional contact of the outside cam plates 37 with the frictional bars 40 and staple guide 12. Once the extension shafts 16, 35 and 35' of the pneumatic cylinders 10, 19 and 19' have completed their extension, the entire staple advancing means will rest in its rearmost position until the sequence begins again.

The supply of staples is contained in circular reel 16 with a strip of parallel abutting staples, adhesively attached only on one side of the strip 11, circularly wound around the center member 15 of the reel 16 between two cover plates 17. As the strip of staples 11 unwinds from the supply reel 16 and nears depletion, a space becomes available on the staple guide 12 for a new strip of staples to be placed onto the staple guide in the space on the staple guide by replacing the empty reels 16. As the new strip of staples becomes straddled on the staple guide 12, it will be urged by the inside cam plates 28 towards the end staple 23 of staple strip 11. Any gap existing between the end staple of staple strip 11 and the frontmost staple of new strip of staples will be closed immediately due to the excess travel of the inside cam plates 28 mentioned earlier.

DETAILS OF AN ADDITIONAL EMBODIMENT

Figure 7:
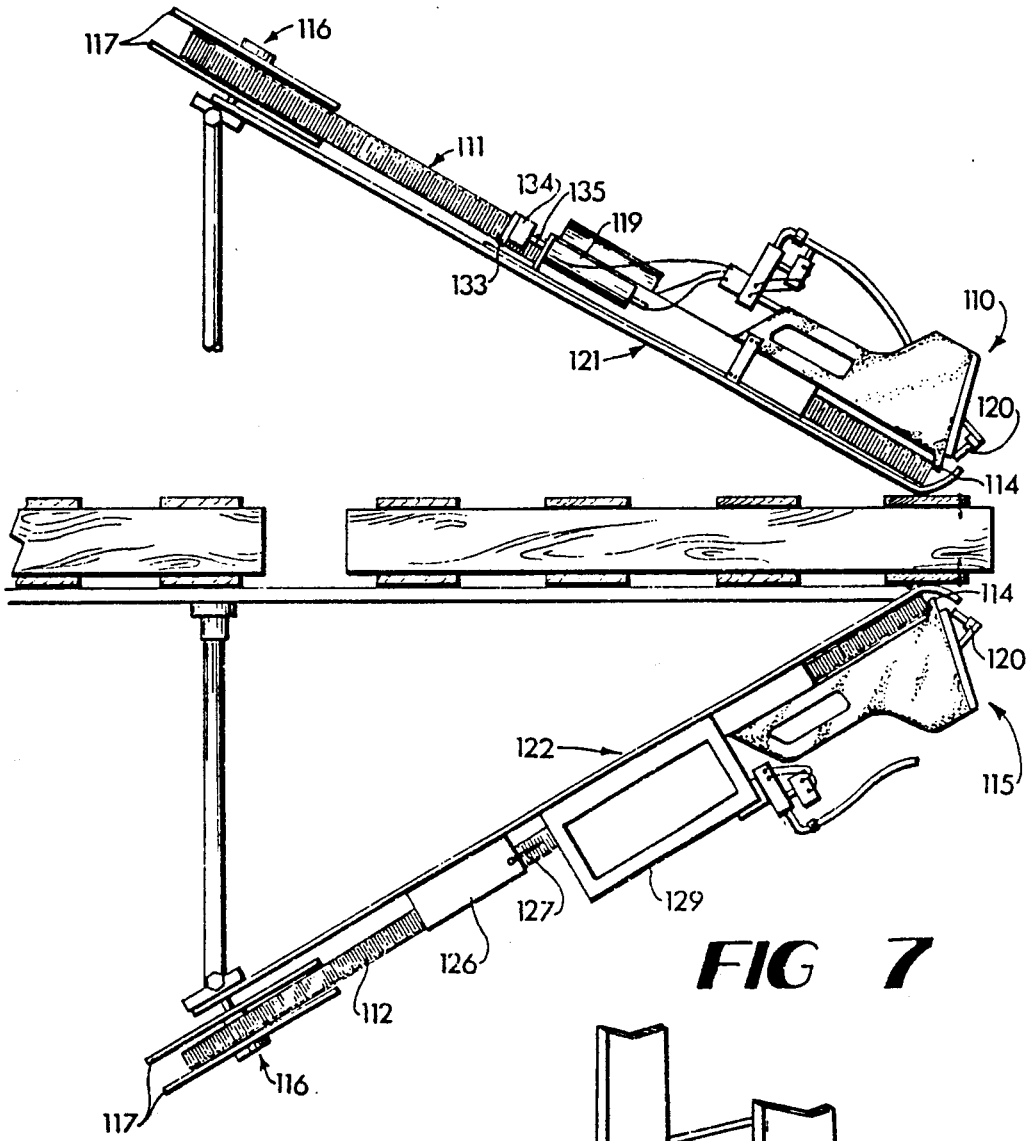
FIG. 7 is an elevation view of a second embodiment of the invention showing a pair of fastening machines one above and one below a work piece for simultaneously driving fasteners into both sides of a work piece.

The embodiment of the invention as it appears when a pair of fastening machines utilized for simultaneously driving fasteners into both sides of a work piece passed between the machines on a surface conveyor is shown in FIGS. 6 and 7.

FIG. 6 is a perspective view of a pair of fastening machines 110, 115 with an upper fastening machine 110 positioned above the upwardly facing surface of a work piece for driving staples downward into the top surface of a work piece, and a lower fastening machine 115 positioned below the downwardly facing surface of the work piece in an orientation for driving staples upwardly into the downwardly facing surface of the work piece. A strip of connected U-shaped staples 111 with the points of the staples facing in a downward direction unwinds from the fastener supply reel 116 of the upper fastening machine extending at a downward angle toward the upper fastening machine 110. An inverted strip of connected U-shaped staples 112 with the points of the staples facing in an upward direction from the fastener supply reel 116 of the lower fastening machine extends at an upward angle along the lower mounting means 122 toward the lower fastening machine 115.

Figure 8:
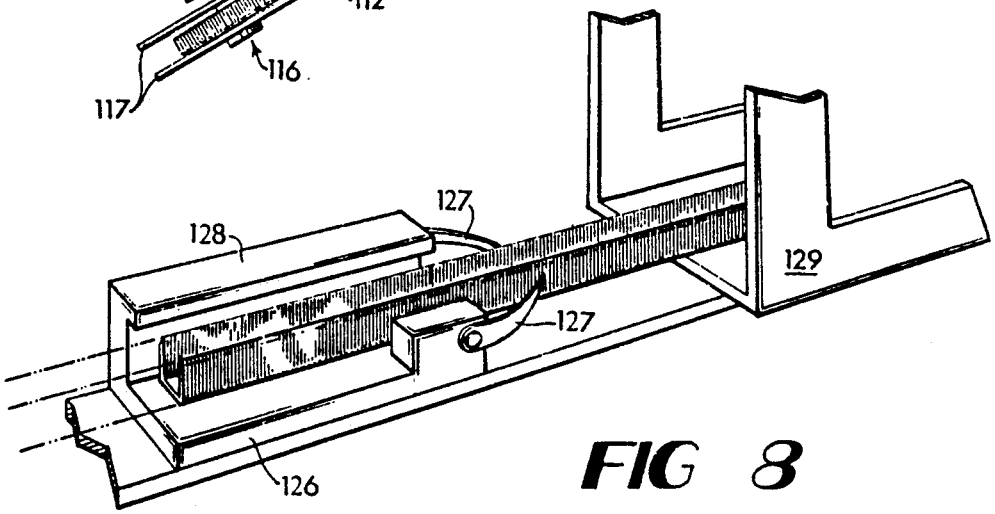
FIG. 8 is a plan view of the spring members of the fastening machine support means.

To oppose the downward force exerted upon the inverted strip of staples 112 of the lower fastening machine 115 by gravity thus causing the staples to exhibit a tendency to fall downward and away from the drive element 112 of the lower fastening machine 115, a fastener support means 126 is attached to the lower mounting means 122. As FIG. 8 details, the fastener support means 126 has a U-shaped rectangular support member 128 open at both ends and partially closed at the downwardly facing edge to provide a contact surface to support the top surface of the inverted strip of staples 112. Affixed to the vertical sides of U-shaped support member 128 are a pair of spring members 127 which engage the side surfaces of the strip of staples 112 to exert a holding force to maintain the position of the strip of staples 112 retarding any backward motion of the staples away from the drive element 114 (FIG. 6) of the lower fastening machine 115.

A photo electric cell or feeler switch can be used to detect the movement of the portions of the work product that are to be fastened and to generate a signal which, actuates the air pressure system that drives the staples into the work product. Both upper and lower fastening machines 110, 115 can be syncrhronized with the pneumatic cylinders 120 connected to the drive element 114 of both the upper and lower fastening machines 110, 115 and the pneumatic cylinders 119 of the advancing means of both the upper and lower fastening machines 110, 115 being connected to the same power means to promote simultaneous operation of the two fastening machines 110, 115 driving fasteners into both sides of a work piece at the same time.

In the alternative, separate detecting switches can be use to actuate the lower and upper fastening machines, depending upon the configuration of the work product.

While this invention has been described in detail with the particular reference to embodiments utilizing staples as the fastener referred and illustrating the use of more than one fastening machine for simultaneously driving staples into both sides of a work piece, it remains obvious that the invention disclosed herein could be applied to other types of fasteners.

It will be understood that the foregoing relates only to preferred embodiments of the present invention and that numerous changes and modifications may be made therein without departing from the spirit and scope of the invention set forth in the following claims.

I claim:

1. A fastening machine of the type used to drive fasteners from an end of a strip of fasteners into a work product, the strip of fasteners comprising fasteners connected to one another in an elongated supply of aligned, parallel abutting fasteners, the fastener machine including an elongated guide means having a discharge end, and an open end remote from said discharge end, a drive element at the discharge end of said guide means for driving the endmost fastener at the end of the strip from the strip of fasteners on said guide means, and fastener advancing means for maintaining the endmost fastener of the strip on said guide means at a position adjacent to said drive element, the improvement therein comprising, said fastener advancing means being affixed to said fastening machine and being open at one end for longitudinally receiving on said guide means at said open end thereof a strip of fasteners and for discharging the fasteners at the other end of said guide means and including advancing means for engaging opposite sides of the fasteners on said guide means, and having power means for simultaneously urging said advancing elements laterally toward each other into engagement within the machine with an intermediate portion of the strip of fasteners on said guide means and along the strip of fasteners parallel to the length of said guide means toward said drive element whereby an elongated strip of fasteners of a length greater than said guide means is progressively moved along its length by said fastener advancing means through the open end of the fastener advancing means toward the discharge end of said guide means as said drive element drives the endmost fastener of the strip at the end of said guide means into a work product, said power means including means for simultaneously urging said advancing elements laterally away from each other for disengaging said advancing elements from the strip of fasteners and moving them along said guide means toward said open end, and means for introducing the fasteners into said machine and said advancing means through said open end.

2. The fastening machine of claim 1 wherein said strip of fasteners is formed in a coil, and further including a fastener strip supply reel for storing a coil of fasteners with the free end of the strip of fasteners extending away from the coil of fasteners longitudinally along said guide means toward said drive element of the fastening machine.

3. The fastener machine of claim 2 wherein said fastener strip supply reel includes a pair of parallel plate members in a spaced relationship between which the strip of staples is arranged in a coil with the free end of the strip extending away from the coiled end of the strip straddling said guide means between said advancing elements toward said drive element of the fastening machine.

4. The fastening machine of claim 1 wherein said elongated guide means further includes an elongated guide member extended between said advancing elements, from one end of said fastener advancing means longitudinally towards a position directly adjacent to said drive means of the fastening machine for supporting the strip of fasteners straddling said guide member as a strip of fasteners is urged toward said drive element of the fastening machine.

5. A fastening machine of the type used to drive fasteners from an end of a strip of fasteners into a work product, the strip of fasteners comprising fasteners connected to one another in an elongated supply of aligned, parallel abutting fasteners, the fastener machine including an elongated guide means having a fastener discharge end, and an open end remote from said discharge end, a drive element at the discharge end of said guide means for driving the endmost fastener at end of the strip from the strip of fasteners on said guide means, and fastener advancing means for maintaining the endmost fastener of the strip on said guide means at a position adjacent said drive element, the improvement therein comprising, said fastener advancing means being open at one end for longitudinally receiving on said guide means at said open end thereof a strip of fasteners and for discharging the fasteners at the other end of said guide means and including a pair of advancing elements on opposite sides of said guide means, and having power means for simultaneously urging said advancing elements laterally toward each other into engagement with an intermediate portion of the strip of fasteners on said guide means and along the strip of fasteners parallel to the length of said guide means toward said drive element whereby an elongated strip of fasteners of a length greater than said guide means is progressively moved along its length by said fastener advancing means through the open end of the fastener advancing means toward the discharge end of said guide means as said drive element drives the endmost fastener of the strip at the end of said guide means into a work product, said power means for simultaneously urging said advancing elements laterally toward each other into engagement with an intermediate portion of the strip of fasteners further including a pair of fluid actuated cylinders adjacent each of said advancing elements, a common connecting member for linking said cylinders together attached to said advancing elements for insuring simultaneous movement of said advancing elements toward the strip of fasteners as said fluid actuated cylinders are actuated at the start of an engagement cycle of the fastening machine, and means for introducing the fasteners into said machine through the open end.

6. A fastening machine of the type used to drive fasteners from an end of a strip of fasteners into a work product, the strip of fasteners comprising fasteners connected to one another in an elongated supply of aligned, parallel abutting fasteners, the fastener machine including an elongated guide means having a fastener discharge end, and an open end remote from said discharge end, a drive element at the discharge end of said guide means for driving the endmost fastener at end of the strip from the strip of fasteners on said guide means, and fastener advancing means for maintaining the endmost fastener of the strip on said guide means at a position adjacent to said drive element, the improvement therein comprising, said fastener advancing means being open at one end for longitudinally receiving on said guide means at said open end thereof a strip of fasteners and for discharging the fasteners at the other end of said guide means and including a pair of advancing elements on opposite sides of said guide means, and having power means for simultaneously urging said advancing elements laterally toward each other into engagement with an intermediate portion of the strip of fasteners on said guide means and along the strip of fasteners parallel to the length of said guide means toward said drive element whereby an elongated strip of fasteners of a length greater than said guide means is progressively moved along its length by said fastener advancing means through the open end of the fastener advancing means toward the discharge end of said guide means as said drive element drives the endmost fastener of the strip at the end of said guide means into a work product, and means for introducing the fasteners into said machine through said open end, said fastening machine further including a fastener machine mounting means extending along the bottom surface of the fastening machine for supporting and orienting the fastening machine in an attitude above the surface of a work product, said fastener machine mounting means comprising a longitudinal support member having a pivotable socket end facilitating rotation movement of the fastening machine and a boot end resting on the surface of a work product guiding the movement of said drive element of the fastening machine as said drive element drives the endmost fastener from the strip of fasteners into the work product.

7. A fastener machine for driving fasteners into a work product comprising:

a fastener drive element, an elongated guide means having a fastener discharge end adjacent said drive element and a fastener receiving open end remote from said drive element for supporting and guiding a strip of fasteners from said fastener receiving open end to said fastener discharge end, fastener advancing means located on opposite sides of said guide means extending over at least a portion along the length of said guide means for engaging the strip of fasteners and advancing said strip along said guide means toward said drive element, means for moving said advancing means in a first, forward strok said forward stroke is greater than the thickness of a staple in a direction toward said fastener discharge end and in a second, reverse stroke in a direction toward said fastener receiving open end, and means disposed longitudinally along the length of said guide means and spaced therefrom for moving said advancing means into engagement with the strip of fasteners at a plurality of longitudinally spaced regions on the first, forward stroke and means for moving said advancing means out of engagement with the strip of fasteners on the second, reverse stroke.

8. The fastening machine as claimed in claim 7 wherein the strip of fasteners has a top surface and side surfaces depending from the top surface whereby the strip of fasteners straddles said guide means, said fastener advancing means being adapted to engage the strip of fasteners on the depending side surfaces thereof.

9. The fastening machine as claimed in claim 7 wherein said fastener advancing means is adapted to maintain sliding frictional contact with the surfaces of the staple strip when the first forward stroke is of greater length than the length of the advancing movement of the strip of staples.

* * * * *